US005854536A

United States Patent [19]

Langlois et al.

[11] Patent Number: 5,854,536

[45] Date of Patent: Dec. 29, 1998

[54] RESONANT CAVITY HAVING A COUPLING ORIFACE FACILITATE COUPLING TO ANOTHER RESONANT CAVITY

[75] Inventors: Michel Langlois, Thonon Les Bains; Gérard Fetre, Vongy, both of France

[73] Assignee: Thomas Tubes Electroniques, Velizy, France

[21] Appl. No.: 560,079

[22] Filed: Nov. 17, 1995

[30] Foreign Application Priority Data

Nov. 18, 1994 [FR] France ..... 94-13840

[51] Int. Cl.[6] ..... H01J 23/16; H01J 23/22; H01J 25/00

[52] U.S. Cl. ..... 315/5; 315/5.39; 333/230

[58] Field of Search ..... 333/230, 24 R; 315/4, 5, 5.39

[56] References Cited

U.S. PATENT DOCUMENTS

| | | | |
|---|---|---|---|
| 2,414,456 | 1/1947 | Edson | 333/230 X |
| 2,444,194 | 6/1948 | Goldstein | 333/230 X |
| 2,543,809 | 3/1951 | Sensiper | 333/209 |
| 2,895,110 | 7/1959 | Nelson et al. | 333/230 X |
| 3,214,684 | 10/1965 | Everitt | 333/230 X |
| 3,427,570 | 2/1969 | Daglian et al. | 333/113 |
| 4,051,447 | 9/1977 | Heckman, Jr. | 333/24 R |
| 4,642,571 | 2/1987 | Minami et al. | 333/230 X |
| 5,239,272 | 8/1993 | Bohlen et al. | 333/230 X |
| 5,300,901 | 4/1994 | Krümmel et al. | 333/230 X |

FOREIGN PATENT DOCUMENTS

| | | |
|---|---|---|
| 2 040 495 | 2/1972 | Germany . |
| 1028229 | 5/1966 | United Kingdom . |
| 1087328 | 10/1967 | United Kingdom . |
| 2277193 | 10/1994 | United Kingdom . |

*Primary Examiner*—Benny T. Lee
*Attorney, Agent, or Firm*—Oblon, Spivak, McClelland, Maier & Neustadt, P.C.

[57] ABSTRACT

A resonant cavity (49) which facilitates coupling to another resonant cavity includes walls (40, 42) and an electrically conducting mast (43). One of the walls (40) has a coupling orifice (41) for coupling the resonant cavity (49) to another resonant cavity. The electrically conducting mast (43) projects from the second wall (42) opposite the first wall (40) and faces the coupling orifice (41). The electrically conducting mast (43) terminates with a hook-shaped portion (44) which contacts an edge of the coupling orifice (41). The resonant cavity (49) is suited for applications requiring secondary output cavities coupled to inductive output tubes.

19 Claims, 6 Drawing Sheets

RESONANT CAVITY HAVING A COUPLING ORIFACE FACILITATE COUPLING TO ANOTHER RESONANT CAVITY

BACKGROUND OF THE INVENTION

FIELD OF THE INVENTION

This invention concerns the field of resonant cavities designed to be coupled to each other and used in electronic tubes particularly for television power amplifiers. The amplifier must have an instantaneous band width of the order of 8 MHz which is compatible with the various standards to transmit both sound and picture at the same time. The operating range lies between 470 MHz and 860 MHz.

DISCUSSION OF BACKGROUND

In the past, klystrons were widely used for television. They have a series of cavities through which the electron beam passes, the required band width in the selected range is obtained by frequency matching devices acting on the resonant frequencies in the various cavities. Usually they have no cavities intended to be coupled to each other. Inductive output tubes (I.O.T.) are now used more and more frequently instead of klystrons, because the efficiency of klystrons is low. But inductive output tubes only have one resonant output cavity through which the electron beam passes, and this "primary" output cavity is coupled with another "secondary" cavity in order to achieve the required frequency ranges and the instantaneous pass band.

Therefore the output circuit of these tubes includes a primary cavity through which the electron beam passes, a secondary cavity, a coupling system between the two cavities and a sampling device that extracts an output signal from the secondary cavity and transmits it to a user device such as an antenna.

The primary and secondary cavities usually include a device that is capable of changing their respective volume and therefore their corresponding resonant frequency. This device may consist of a mobile wall. The sampling device usually consists of a loop that contains lines of the magnetic field present in the secondary cavity.

In some inductive output tubes, the secondary cavity is coupled to the primary cavity through a coupling orifice. This type of output circuit cannot cover the entire range of television frequencies, and the tube manufacturer must propose several types of secondary cavities with different dimensions to cover the entire range. In other inductive output tubes, the coupling circuit between the two cavities consists of a loop that projects into the primary cavity and is extended by a conducting shaft and terminates in the secondary cavity at a button shaped conducting body. The coupling circuit is electrically insulated from the cavity walls. Since the cavities are insulated and have coupling orifices and contain high frequency energy, there is a risk that the coupling circuit could become electrically charged and that electrical arcs could be set up between the coupling circuit and the walls. These electric arcs will destroy the coupling between the two cavities.

SUMMARY OF THE INVENTION

This invention is intended to overcome these disadvantages by the use of a resonant cavity with a coupling orifice to facilitate coupling to another resonant cavity. This cavity does not have any parts electrically insulated from the walls, and there is less risk of electrical arcs.

The resonant cavity according to the invention contains a coupling orifice in one of its walls to couple it to another cavity and to an electrically conducting mast projecting from another wall opposite the first wall towards the coupling orifice, this mast terminating in a hook shaped part in contact with the edge of the coupling orifice.

The hook shaped part may be made of an elbow located approximately in the plane of the wall containing the coupling orifice.

The mast may also project outside the cavity through the coupling orifice. In this configuration the mast penetrates into the cavity to which it is coupled and facilitates adjustment of the degree of coupling between the two cavities.

It is preferable if the cavity includes means of varying its volume, so that its resonant frequency can be changed.

Preferably, a loop projects into the cavity in order to extract or inject hyperfrequency energy.

An elongated conducting element, approximately parallel to the electrically conducting mast, may also be placed in the cavity. This element projects into the cavity through the wall opposite to the wall containing the coupling orifice. For a given resonant frequency, it can reduce the size of the cavity. It can also facilitate coupling between the sampling loop or injection loop, and the inside of the cavity.

This invention also concerns an electron beam tube such as an inductive output tube containing a primary cavity through which the electron beam passes, and a resonant cavity with facilitated coupling as described above.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
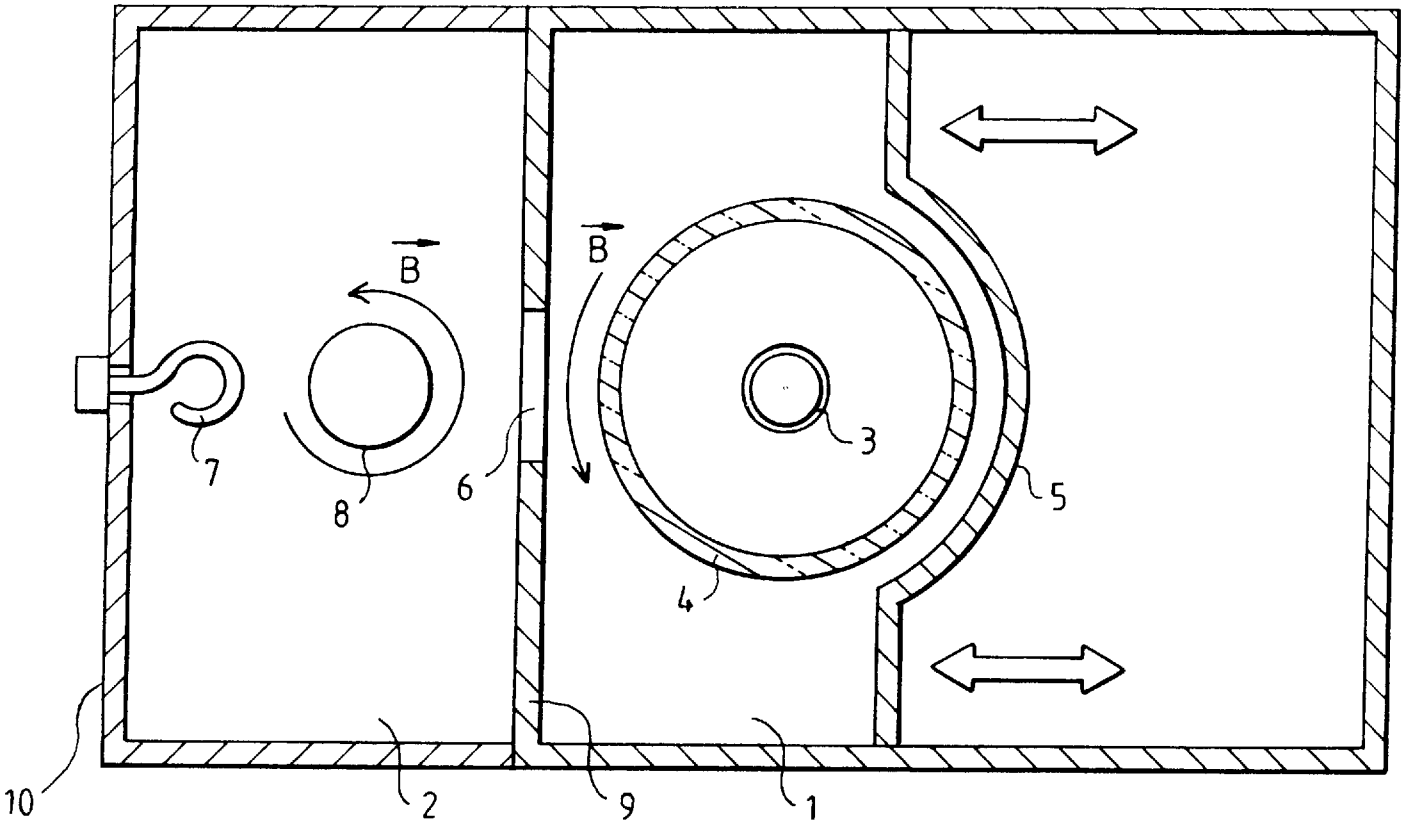
FIG. 1 PRIOR ART
FIG. 1 is a transverse cross-section through an inductive output tube made according to known methods.

FIG. 1 shows a transverse cross-section of a primary cavity coupled to a secondary cavity in a known inductive output tube.

The primary cavity is identified as reference 1 and the secondary cavity as reference 2. The primary cavity 1 contains drift tubes 3 which guide electrons in a beam emitted by an electron gun (not shown). The electron beam on the figure would be normal to the plane of the paper.

The primary cavity 1 includes a central part containing a vacuum around drift tubes 3 and an outer part containing air. An isolating cylinder 4 separates these two parts. This cylinder 4 is usually made of ceramic.

The primary cavity may contain at least one mobile wall 5 whose motion is designated by the dual headed arrow(s) so that its volume can be varied to adjust its resonant frequency.

The primary cavity 1 is coupled to the secondary cavity through coupling orifice 6 which provides a communication between the two cavities 1, 2. In FIG. 1, cavities 1 and 2 have a common wall 9 in which orifice 6 is formed. Hyperfrequency energy amplified by the tube is transmitted from primary cavity I to secondary cavity 2. A conducting loop 7 projects into secondary cavity 2, and is designed to sample hyperfrequency energy present in the secondary cavity and transmit it to a user device located outside the cavity. This device is not shown. Conducting loop 7 passes through a secondary cavity wall 10 opposite wall 9 containing the coupling orifice.

Secondary cavity 2 contains a conducting pin 8 fixed to one of its other walls and directed towards the center of the secondary cavity. This pin 8 is oriented in the same direction as the lines of the electric field which is set up in the secondary cavity.

These cavities 1 and 2 usually both operate in $TE_{010}$ mode. Lines of electric field in the secondary cavity 2 are normal to the plane of the paper and lines of magnetic field $\vec{B}$ surround pin 8. Lines of magnetic field $\vec{B}$ in primary cavity 1 surround sliding tubes 3, whereas lines of electric field are normal to the plane of the paper.

This tube output circuit cannot cover all required frequency ranges, and several types of secondary cavities with different dimensions have to be provided to solve this problem.

Figure 2:
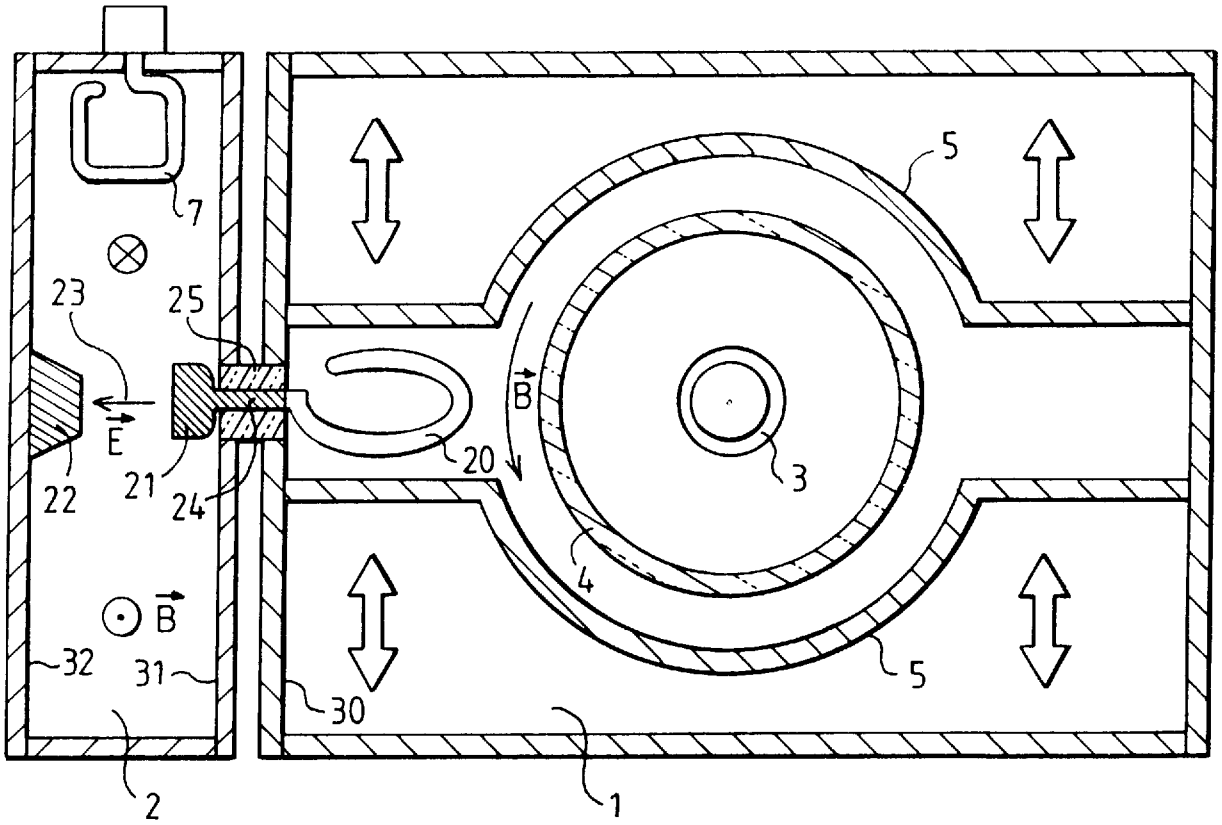
FIG. 2 PRIOR ART
FIG. 2 is a transverse cross-section through another known type of inductive output tube.

In other known inductive output tubes such as the tube shown in FIG. 2, the coupling between the primary cavity 1 and the secondary cavity 2 is made by a loop 20 which projects into the primary cavity 1 from wall 30, and which surrounds the lines of magnetic field $\vec{B}$, instead of a coupling orifice. The inductive output tube of FIG. 2 also includes drift tubes 3.

Loop 20 is extended by a button shaped conducting element 21 which projects into the secondary cavity 2 from one of its walls 31.

Loop 20 and conducting element 21 are connected by conducting shaft 24 which passes through the two walls 30, 31.

In secondary cavity 2, there is a conducting protuberance 22 fixed to wall 32 opposite the wall which supports the button shaped conducting element 21. This protuberance 22 projects towards the button shaped conducting element 21, delimiting a space 23. A dielectric sleeve 25 electrically isolates the conducting shaft 24, the loop 20 and the button shaped conducting element 21 from walls 30, 31. Cavity walls are usually grounded. Cavities are usually ventilated. Air circulation and the hyperfrequency energy present in the cavities cause electrical charging of loop 20 and the button shaped conducting element 21. Electrical arcs may then be set up between the coupling circuit and walls which could destroy the coupling between the two cavities.

Conventionally, the primary cavity 1 includes means of varying its internal volume in order to adjust its resonant frequency. This device consists of two walls 5 in the primary cavity which are mobile whose motion is designated by the dual headed arrow(s). In this example, as shown in FIG. 1, a conducting loop 7 projects into the secondary cavity 2 to sample the hyperfrequency energy present and to transmit it to a user device located outside the cavity. This device is not shown.

The mode set up in the cavities for this example is also $TE_{010}$. The lines of magnetic field $\vec{B}$ are shown. In primary cavity 1, lines of the magnetic field surround sliding tubes and lines of electric field are normal to the plane of the paper.

In secondary cavity 2, lines of magnetic field $\vec{B}$ (which are designated by the ⊙ and ⊗ symbols) surround the button shaped conducting element 21 and lines of electric field $\vec{E}$ are set up between the button shaped conducting element 21 and protuberance 22.

Conducting loop 7 is placed so that it surrounds lines of magnetic field.

Figure 3A:
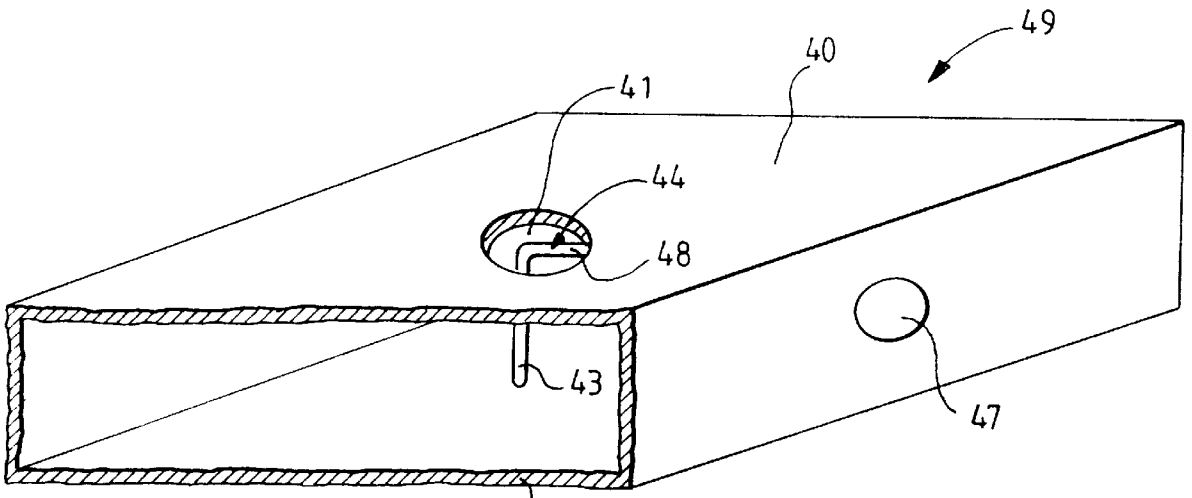
FIGS. 3*a*, 3*b* and 3*c* show an exploded perspective view, a cross-section and a top view of a cavity according to the invention, respectively.
Figure 3B:
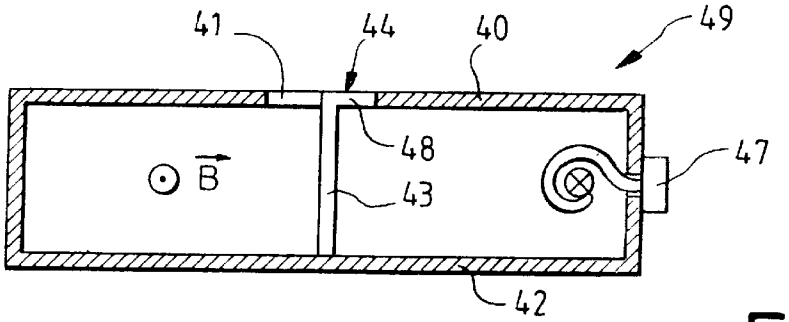
Figure 3C:
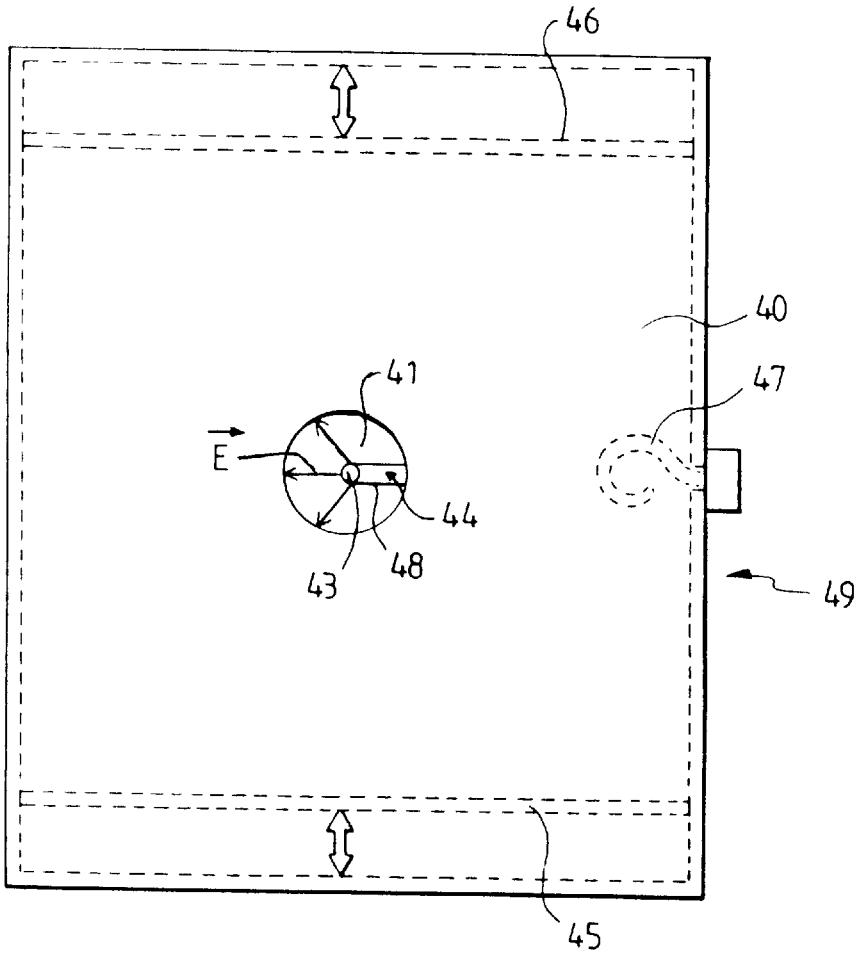

FIGS. 3*a*, 3*b* and 3*c* show an example of a resonant cavity 49 intended to be coupled according to the invention. FIG. 3*a* shows an exploded perspective view, FIG. 3*b* shows a front cross-section and FIG. 3*c* shows a top view. Resonant cavity 49 in this example is parallelepiped-shaped and is delimited by conducting walls. It would have been possible to envisage another shape, for example cylindrical.

Figure 4A:
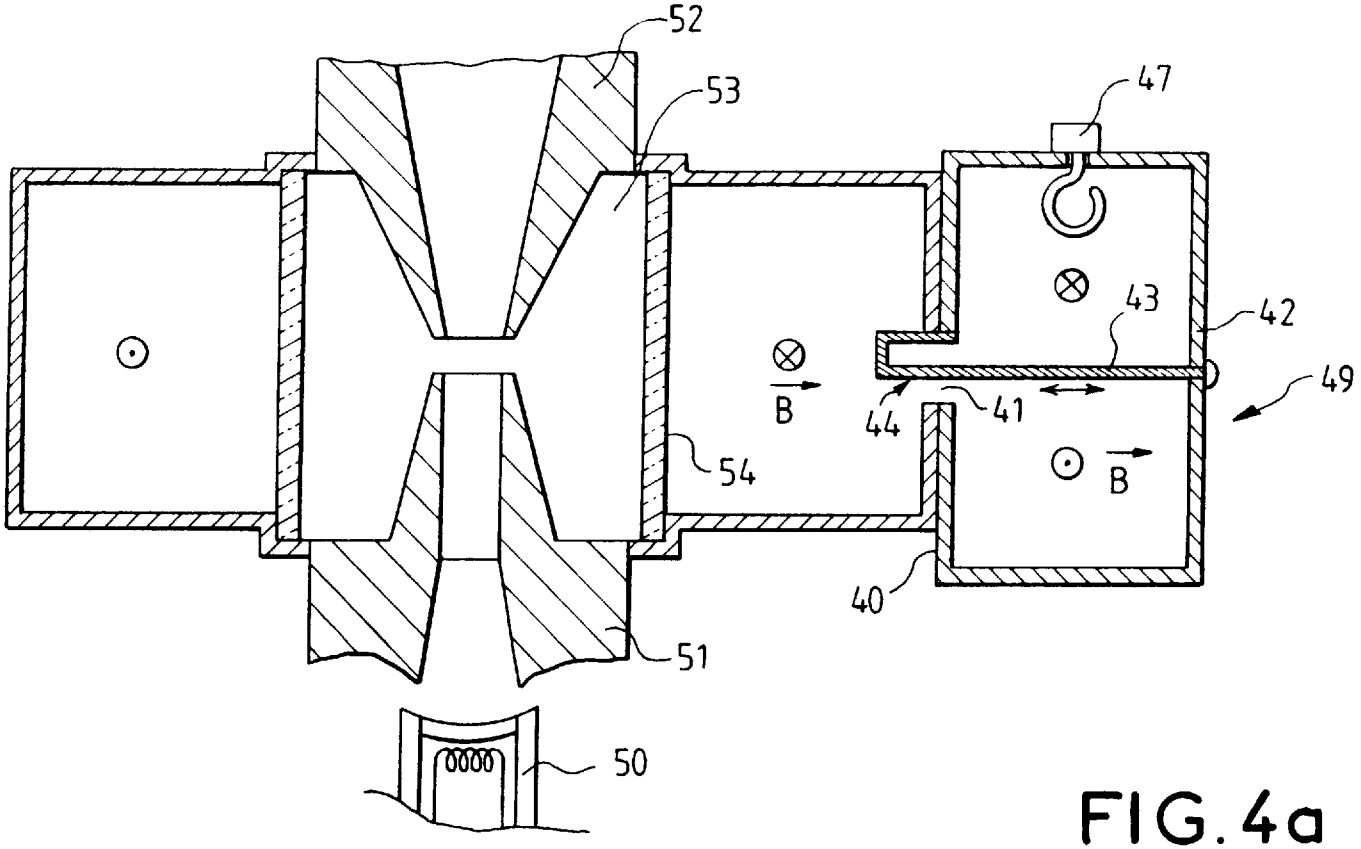
FIGS. 4*a* and 4*b* show two partial longitudinal cross-sections through an inductive output tube equipped with a cavity according to the invention.
Figure 4B:
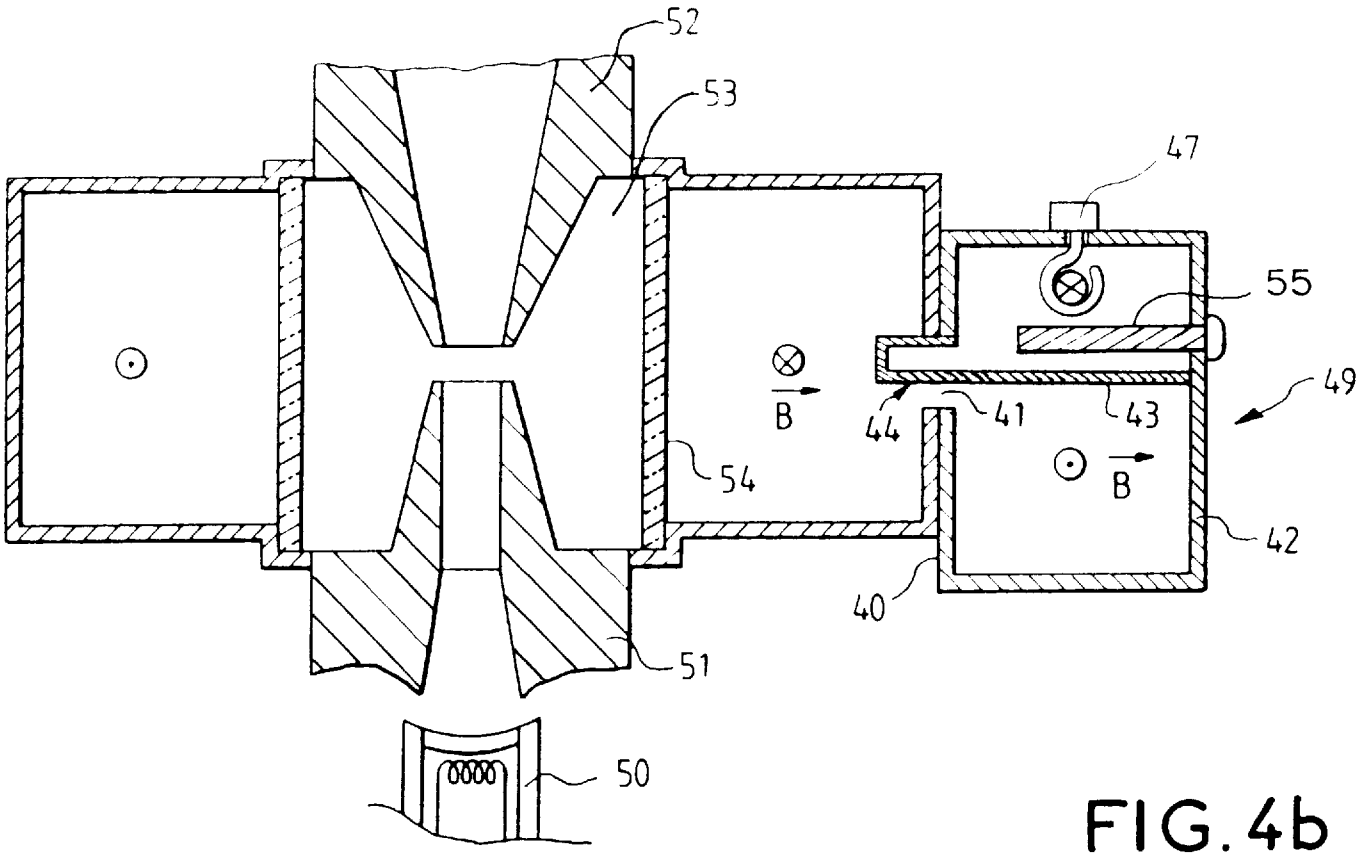

One of the walls 40 contains a coupling orifice 41 which contributes to making it communicate with another cavity to which it is coupled. FIGS. 4*a* and 4*b* show a secondary cavity coupled to the "primary" cavity of the inductive output tube of FIGS. 3*a*–3*c*.

An electricity conducting mast 43 is fixed in cavity 49 to a wall 42 (see FIGS. 3*a*, 3*b*) opposite the wall containing the coupling orifice 41 and opposite coupling orifice 41.

This mast 43 is terminated by a hook-shaped part 44 in contact with the edge of the coupling orifice 41.

In the example shown, mast 43 and coupling orifice 41 are located in the central part of cavity 49. In this case, mast 43 is approximately normal to walls 40 and coupling orifice 41 and is aimed towards the central part of coupling orifice 41. The hook-shaped part 44 is simply bent from the rest of the mast 43. Elbow 48 is approximately in the same plane as wall 40 which supports coupling orifice 41, and its end is in contact with the edge of the coupling orifice. Obviously, other configurations are also possible.

When this cavity 49 is coupled to a primary cavity in the inductive output tube in which a $TE_{010}$ mode is set up, the lines of electric field $\vec{E}$ at the coupling orifice 41 are radial as seen in FIG. 3*c*. The electric field is zero along the hook-shaped part 44 and maximum between mast 43 and the edge of the coupling orifice diametrically opposite the contact point with the elbow. In this configuration, the predominant coupling between the two cavities is electrical.

Conventionally, cavity 49 may include a device for adjustment of its volume and consequently its resonant frequency. Two mobile walls 45 and 46 whose motion is designated by the dual headed arrow(s) are shown diagrammatically on FIG. 3*c*, and are contiguous with wall 40 which contains the coupling orifice 41.

Also conventionally, cavity 49 which in this case is an output cavity contains a loop 47 from which hyperfrequency energy inside the cavity is sampled. This loop 47 projects into cavity 49 surrounding lines of magnetic fields $\vec{B}$ (which are designated by the ⊙ and ⊗ symbols) which are set up. Lines of magnetic field $\vec{B}$ (which are designated by the ⊙ and ⊗ symbols) are shown on FIGS. 4*a* and 4*b*.

In order to improve coupling between two cavities, mast 43 may include a part which projects out of the cavity through coupling orifice 41.

This is shown in FIG. 4*a*. This figure contains a longitudinal cross-section showing a primary output cavity 53 from the inductive output tube coupled to a cavity in accordance with the invention. The primary cavity 53 is conform with the cavities in FIGS. 1 and 2. The section is now longitudinal, and shows an electron gun 50 to produce electrons, and two drift tubes 51 and 52 on each side of the primary cavity 53.

The isolating cylinder around sliding tubes 51 and 52 is reference numeral 54. Lines of magnetic field $\vec{B}$ (which are designated by the ⊙ and ⊗ symbols) surround drift tubes 51 and 52.

The resonant cavity complying with the invention has the same reference numbers as are used in FIGS. 3*a*, 3*b* and 3*c*. Mast 43 penetrates into primary cavity 53, and its hook-shaped part 44 surrounds the lines of magnetic field $\vec{B}$ that are set up. Mode $TE_{010}$ is set up in primary cavity 53. The degree of coupling between the two cavities depends on the portion of the mast 43 that penetrates into primary cavity 53. The penetration of mast 43 into the primary cavity 53 may be adjusted from the outside.

The hook-shaped part 44 is no longer a simple elbow, but is now a curved loop, the end of which is in contact with the edge of the coupling orifice 41. In this case the curved loop is formed of two segments at a right angle. Coupling between the two cavities 53 and 49 is both electric and magnetic. The mode set up in cavity 49 is no longer $TE_{010}$ due to the presence of mast 43. This mode has lines of magnetic field $\vec{B}$ (which are designated by the ⊙ and ⊗ symbols) that surround mast 43. The sampling loop 47 is placed so that it also surrounds these lines of magnetic field.

Mobile walls are not visible on this figure and are parallel to the plane of the paper.

Mast 43 and coupling orifice 41 need not be located in the central part of cavity 49. This is shown in FIG. 4*b*. Mast 43 is offset from the central part of the wall 42 towards the sampling or injection loop 47. This configuration can reduce the sizes of cavity 49. This is useful since it is always desirable to reduce the dimensions. Elements on FIG. 4*b* have the same references as the corresponding elements on FIG. 4*a*. Mast 43 is fixed on this alternative. Its bottom is rigidly attached to wall 42, and its end is rigidly attached to the edge of coupling orifice 41.

An elongated conducting element 55 could be placed in cavity 49 according to the invention, approximately parallel to the electricity conducting mast 43. This element is fixed to wall 42 that supports mast 43. It is preferably cylindrical, it has a capacitive effect and may be mobile or fixed. It can reduce the resonant frequency of the cavity for constant dimensions, or can reduce the dimensions of the cavity for constant frequency. If it is placed between sampling loop 47 and mast 43, it concentrates the magnetic fields $\vec{B}$ (which are designated by the ⊙ and ⊗ symbols) towards loop 47. It facilitates coupling and can reduce the dimensions of loop 47.

Mast 43 may be made of an electricity conducting material such as copper or aluminium. The walls of the cavity are generally made of aluminium, copper or brass. Mast 43 may be fixed to wall 42, for example by brazing or welding, and to the coupling orifice 41 if it is fixed. If the position of mast 43 can be adjusted to vary the degree of coupling between the two cavities as shown on FIG. 4*a*, there is a mechanical and electrical contact between mast 43 and wall 42, and between mast 43 and the coupling orifice 41.

For example, hook-shaped part 44 may be made by bending or by assembling one or several segments. The hook-shaped parts shown are only examples. Other shapes are possible within the scope of the invention.

Although the above description was made for inductive output tubes, the resonant cavity according to the invention may be used with any type of electron beam tube with at least one coupled resonant cavity.

The above description concerned a secondary output resonant cavity. The invention may also be applied to a secondary input cavity coupled to a primary input cavity. In this configuration, instead of including a hyperfrequency energy sampling loop, the secondary input resonant cavity would include a hyperfrequency energy injection loop. Obviously, numerous modifications and variations of the present invention are possible in light of the above teachings. It is therefore to be understood that within the scope of the appended claims, the invention may be practiced otherwise than as specifically described herein.

We claim:

1. A resonant cavity delimited by walls comprising:

a first wall having a coupling orifice therein to couple said resonant cavity to another cavity;

a second wall opposite the first wall; and an electrically conducting mast projecting from the second wall, said electrically conducting mast terminating at one end thereof with a hook-shaped portion, the hook-shaped portion being in contact with an edge of the coupling orifice, another end of the electrically conducting mast being in contact with the second wall;

wherein said electrically conducting mast faces the coupling orifice from said second wall to said first wall.

2. The resonant cavity according to claim 1, wherein the first wall has a substantially planar configuration, and a top portion of the hook-shaped portion is located substantially in the plane of the first wall.

3. The resonant cavity according to claim 1, wherein the hook-shaped portion projects through the coupling orifice.

4. The resonant cavity according to claim 3, wherein the hook-shaped portion adjustable projects through the coupling orifice.

5. The resonant cavity according to claim 3, wherein the hook-shaped portion is in a form of a loop.

6. The resonant cavity according to claim 1, wherein the one end of the hook-shaped portion is rigidly attached to the edge of the coupling orifice.

7. The resonant cavity according to claim 1, wherein the electrically conducting mast is attached at substantially a central portion of the second wall.

8. The resonant cavity according to claim 1, further comprising a device located in the resonant cavity for varying a volume of the resonant cavity.

9. The resonant cavity according to claim 1, further comprising a hyperfrequency energy sampling loop located in the resonant cavity.

10. The resonant cavity according to claim 9, wherein the electrically conducting mast is located offset from a central portion of the second wall at a position towards the sampling loop.

11. The resonant cavity according to claims 9, further comprising an elongated conducting element substantially parallel to the electrically conducting mast.

12. The resonant cavity according to claim 11, wherein the elongated conducting element is located between the sampling loop and the electrically conducting mast.

13. The resonant cavity according to claim 1, wherein the coupling orifice is in the form an opening in said first wall and the hook-shaped portion is in contact with an edge of the opening of the coupling orifice.

14. The resonant cavity according to claim 1, further comprising a hyperfrequency energy injection loop located in the resonant cavity.

15. The resonant cavity according to claim 14, further comprising an elongated conducting element substantially parallel to the electrically conducting mast.

16. The resonant cavity according to claim 15, wherein the elongated conducting element is located between the injection loop and the electrically conducting mast.

17. The resonant cavity according to claim 14, wherein the electrically conducting mast is located offset from a central portion of the second wall at a position towards the injection loop.

18. An electron beam tube comprising:

at least one cavity through which an electron beam passes; and a resonant cavity coupled to the at least one cavity through which the electron beam passes, said resonant cavity including, a first wall having a coupling orifice therein to couple said resonant cavity to said at least one cavity, a second wall opposite the first wall, and an electrically conducting mast, projecting from the second wall and towards the coupling orifice, the electrically conducting mast terminating at one end thereof with a hook-shaped portion, the hook-shaped portion being in contact with an edge of the coupling orifice, another end of the electrically conducting mast being in contact with the second wall.

19. The electron beam tube according to claim 18, wherein the coupling orifice is in the form an opening in said first wall and the hook-shaped portion is in contact with an edge of the opening of the coupling orifice.

* * * * *

UNITED STATES PATENT AND TRADEMARK OFFICE

CERTIFICATE OF CORRECTION

PATENT NO. : 5,854,536

DATED : December 29, 1998

INVENTOR(S) : Michel LANGLOIS et al.

It is certified that error appears in the above-identified patent and that said Letters Patent is hereby corrected as shown below:

On the title page, item [54] the Title should read:

--[54] RESONANT CAVITY HAVING A COUPLING ORIFICE TO FACILITATE COUPLING TO ANOTHER RESONANT CAVITY-- item [73] Assignee name should read:

--[73] Assignee: THOMSON TUBES ELECTRONIQUES, Velizy, France--

Signed and Sealed this

Twenty-fifth Day of May, 1999

*Attest:*

Q. TODD DICKINSON

*Attesting Officer*

*Acting Commissioner of Patents and Trademarks*